US009317004B1

(12) United States Patent
Boettcher et al.

(10) Patent No.: US 9,317,004 B1
(45) Date of Patent: Apr. 19, 2016

(54) HANDLE AND POSITIONING STOP ASSEMBLY FOR A REPLACEABLE UNIT OF AN ELECTROPHOTOGRAPHIC IMAGE FORMING DEVICE

(71) Applicant: Lexmark International, Inc., Lexington, KY (US)

(72) Inventors: Brian Lester Boettcher, Versailles, KY (US); Michael David Maul, Lexington, KY (US); Jennifer Marie Murphy, Lexington, KY (US); Joshua Carl Poterjoy, Mount Joy, PA (US)

(73) Assignee: Lexmark International, Inc., Lexington, KY (US)

( * ) Notice: Subject to any disclaimer, the term of this patent is extended or adjusted under 35 U.S.C. 154(b) by 0 days.

(21) Appl. No.: 14/725,224

(22) Filed: May 29, 2015

Related U.S. Application Data

(60) Provisional application No. 62/145,642, filed on Apr. 10, 2015.

(51) Int. Cl.
*G03G 21/18* (2006.01)
*G03G 21/16* (2006.01)

(52) U.S. Cl.
CPC ..... *G03G 21/1647* (2013.01); *G03G 21/185* (2013.01); *G03G 21/1842* (2013.01)

(58) Field of Classification Search
CPC ..... G03G 21/1647; G03G 21/1842; G03G 21/185
See application file for complete search history.

(56) References Cited

U.S. PATENT DOCUMENTS 5,066,976 A 11/1991 Kanagawa et al.
5,313,993 A 5/1994 Corby et al.
5,434,655 A 7/1995 Okamura
5,583,612 A 12/1996 Schell et al.
5,758,233 A 5/1998 Coffey et al.
5,787,322 A * 7/1998 Sass ..... G03G 21/1647 399/110
5,819,139 A 10/1998 Harlan et al.
5,842,093 A 11/1998 Tanda (Continued)

FOREIGN PATENT DOCUMENTS

JP 03180861 A * 8/1991

OTHER PUBLICATIONS

U.S. Appl. No. 14/725,195, filed May 29, 2015.

(Continued)

*Primary Examiner* — David Gray
*Assistant Examiner* — Laura Roth
(74) *Attorney, Agent, or Firm* — Justin M Tromp

(57) ABSTRACT

A replaceable unit for an electrophotographic image forming device includes a housing having a photoconductive drum rotatably mounted thereon. The photoconductive drum has a rotational axis. A guide channel on an exterior of the housing extends parallel to the rotational axis of the photoconductive drum and is positioned to guide insertion of the housing into the image forming device. A positioning stop on the housing is movable between a latching position and an unlatching position. In the latching position the positioning stop obstructs at least a portion of the guide channel to limit the travel of the replaceable unit in the image forming device parallel to the rotational axis of the photoconductive drum. A release handle on the housing is operatively connected to the positioning stop to move the positioning stop from the latching position of the positioning stop to the unlatching position of the positioning stop.

22 Claims, 15 Drawing Sheets

(56) References Cited

U.S. PATENT DOCUMENTS

| | | | | |
|---|---|---|---|---|
| 6,115,571 | A | 9/2000 | Kobayashi | |
| 6,301,456 | B1 | 10/2001 | Horrall et al. | |
| 6,314,256 | B1 | 11/2001 | Saitoh | |
| 6,386,681 | B1 | 5/2002 | Askren et al. | |
| 6,470,163 | B1 | 10/2002 | Minagawa | |
| 6,530,399 | B2 | 3/2003 | Nguyen et al. | |
| 6,692,107 | B2 | 2/2004 | Lattuca et al. | |
| 7,133,629 | B2 | 11/2006 | Kita | |
| 7,136,609 | B2 | 11/2006 | Askren et al. | |
| 7,159,973 | B2 | 1/2007 | Buchanan et al. | |
| 7,168,799 | B2 | 1/2007 | Benson et al. | |
| 7,258,558 | B1 | 8/2007 | Dawson et al. | |
| 7,272,336 | B1 | 9/2007 | Dawson et al. | |
| 7,305,204 | B2 | 12/2007 | Carter et al. | |
| 7,641,313 | B2 | 1/2010 | LaBar | |
| 7,734,230 | B2 | 6/2010 | Takami | |
| 7,769,321 | B2 | 8/2010 | Tanaka | |
| 7,831,168 | B2 | 11/2010 | Allen et al. | |
| 7,840,165 | B2 | 11/2010 | Okuda | |
| 7,905,572 | B2 | 3/2011 | Anderson, Jr. et al. | |
| 7,953,347 | B2 | 5/2011 | Dawson et al. | |
| 7,992,982 | B2 | 8/2011 | Scharf | |
| 8,200,126 | B2 | 6/2012 | Chaudhuri et al. | |
| 8,292,411 | B2 | 10/2012 | Anderson, Jr. et al. | |
| 8,342,642 | B2 | 1/2013 | Bailey et al. | |
| 8,401,434 | B2 | 3/2013 | Akaike | |
| 8,509,650 | B2 | 8/2013 | Kikuchi et al. | |
| 8,567,932 | B2 | 10/2013 | James, III et al. | |
| 8,706,005 | B2 | 4/2014 | Okabe | |
| 8,761,639 | B1 | 6/2014 | Leemhuis et al. | |
| 2001/0021320 | A1* | 9/2001 | Murayama | G03G 21/185 399/117 |
| 2002/0057317 | A1 | 5/2002 | Cowger et al. | |
| 2003/0053819 | A1 | 3/2003 | Nomura et al. | |
| 2003/0219284 | A1 | 11/2003 | Ishiguro et al. | |
| 2005/0265736 | A1 | 12/2005 | Seto et al. | |
| 2006/0013621 | A1 | 1/2006 | Kimura et al. | |
| 2006/0169067 | A1 | 8/2006 | Yoshizawa | |
| 2007/0098455 | A1 | 5/2007 | Kuma et al. | |
| 2007/0206972 | A1 | 9/2007 | Tanaka | |
| 2007/0229619 | A1 | 10/2007 | Sugahara et al. | |
| 2008/0138105 | A1 | 6/2008 | Kanno et al. | |
| 2008/0138106 | A1 | 6/2008 | Kanno et al. | |
| 2009/0016779 | A1 | 1/2009 | Hwang | |
| 2009/0080909 | A1 | 3/2009 | Usui et al. | |
| 2009/0290904 | A1* | 11/2009 | Kawai | G03G 21/1842 399/111 |
| 2009/0297211 | A1 | 12/2009 | Kanno et al. | |
| 2011/0076055 | A1* | 3/2011 | Lee | G03G 21/1633 399/110 |
| 2011/0091222 | A1 | 4/2011 | Kim et al. | |
| 2011/0129252 | A1 | 6/2011 | Oda et al. | |
| 2011/0299873 | A1* | 12/2011 | Ushiozu | G03G 15/04054 399/90 |
| 2011/0299882 | A1* | 12/2011 | Tanaami | G03G 15/326 399/110 |
| 2012/0070187 | A1 | 3/2012 | Takeuchi et al. | |
| 2012/0163858 | A1 | 6/2012 | Fujii et al. | |
| 2012/0315066 | A1 | 12/2012 | Dawson et al. | |
| 2013/0004203 | A1 | 1/2013 | Ohnishi | |
| 2013/0142538 | A1 | 6/2013 | Miwa et al. | |
| 2013/0147885 | A1 | 6/2013 | Harvey et al. | |
| 2013/0170867 | A1 | 7/2013 | Acosta et al. | |
| 2013/0170868 | A1 | 7/2013 | Acosta et al. | |
| 2013/0209141 | A1 | 8/2013 | Hackney et al. | |
| 2013/0259528 | A1 | 10/2013 | Yamamoto | |
| 2013/0287448 | A1 | 10/2013 | Baker et al. | |
| 2015/0098721 | A1 | 4/2015 | Buchanan et al. | |
| 2015/0098730 | A1 | 4/2015 | Buchanan et al. | |
| 2015/0098731 | A1 | 4/2015 | Leemhuis et al. | |
| 2015/0139688 | A1 | 5/2015 | Leemhuis et al. | |
| 2015/0139698 | A1 | 5/2015 | Leemhuis et al. | |
| 2015/0268609 | A1 | 9/2015 | Yamada | |
| 2015/0331386 | A1 | 11/2015 | Tanaami et al. | |

OTHER PUBLICATIONS

U.S. Appl. No. 14/576,826, filed Dec. 19, 2014.

U.S. Appl. No. 14/576,777, filed Dec. 19, 2014.

U.S. Appl. No. 15/014,173, filed Feb. 3, 2016 (Boettcher et al.).

U.S. Appl. No. 15/040,427, filed Feb. 10, 2016 (Boettcher et al.).

Notice of Allowance dated Jan. 20, 2016 for U.S. Appl. No. 14/725,195.

* cited by examiner

HANDLE AND POSITIONING STOP ASSEMBLY FOR A REPLACEABLE UNIT OF AN ELECTROPHOTOGRAPHIC IMAGE FORMING DEVICE

CROSS REFERENCES TO RELATED APPLICATIONS

This application claims priority to U.S. Provisional Patent Application Ser. No. 62/145,642, filed Apr. 10, 2015, entitled "Handle and Positioning Stop Assembly for a Replaceable Unit of an Electrophotographic Image Forming Device," the content of which is hereby incorporated by reference in its entirety.

BACKGROUND

1. Field of the Disclosure

The present disclosure relates generally to image forming devices and more particularly to a handle and positioning stop assembly for a replaceable unit of an electrophotographic image forming device.

2. Description of the Related Art

In order to reduce the premature replacement of components traditionally housed within a toner cartridge for an image forming device, toner cartridge manufacturers have begun to separate components having a longer life from those having a shorter life into separate replaceable units. The image forming device's main toner supply, which is consumed relatively quickly, is provided in a large reservoir in a first replaceable unit, which may be referred to as a toner cartridge. Relatively longer life components are provided in one or more additional replaceable units. For example, the developer roll, toner adder roll, doctor blade and a relatively small reservoir of toner (in the case of a single component development image forming device) or the magnetic roll and a relatively small reservoir containing a mix of toner and magnetic carrier beads (in the case of a dual component development image forming device) may be provided in a second replaceable unit, which may be referred to as a developer unit. The photoconductive drum, charge roll and cleaner blade/roll may be provided in a third replaceable unit, which may be referred to as a photoconductor unit. This configuration allows replenishment of the image forming device's toner supply without replacing the developer unit or the photoconductor unit. This configuration also allows the developer unit and the photoconductor unit to be repaired or replaced independent of the image forming device's main toner supply.

It is important that the replaceable units are precisely aligned within the image forming device for proper operation. The requirement for precise alignment must be balanced with the need to permit a user to easily load and unload the replaceable units into and out of the image forming device.

SUMMARY

A replaceable unit for an electrophotographic image forming device according to one example embodiment includes a housing having a photoconductive drum rotatably mounted thereon. The photoconductive drum has a rotational axis. A guide channel on an exterior of the housing extends parallel to the rotational axis of the photoconductive drum and is positioned to guide insertion of the housing into the image forming device. A positioning stop on the housing is movable between a latching position and an unlatching position. In the latching position the positioning stop obstructs at least a portion of the guide channel to limit the travel of the replaceable unit in the image forming device parallel to the rotational axis of the photoconductive drum. A release handle on the housing is operatively connected to the positioning stop to move the positioning stop from the latching position of the positioning stop to the unlatching position of the positioning stop.

A replaceable unit for an electrophotographic image forming device according to another example embodiment includes a housing having a photoconductive drum rotatably mounted thereon. The photoconductive drum has a rotational axis. A guide channel on an exterior of the housing extends along a bottom side of the housing parallel to the rotational axis of the photoconductive drum and is positioned to guide insertion of the housing into the image forming device. A positioning stop on the housing is translatable up and down perpendicular to the rotational axis of the photoconductive drum between a latching position and an unlatching position. The positioning stop translates downward from the unlatching position of the positioning stop toward the latching position of the positioning stop and upward from the latching position of the positioning stop toward the unlatching position of the positioning stop. In the latching position the positioning stop obstructs at least a top portion of the guide channel to limit the travel of the replaceable unit in the image forming device parallel to the rotational axis of the photoconductive drum. A release handle on the housing is operatively connected to the positioning stop to move the positioning stop from the latching position of the positioning stop to the unlatching position of the positioning stop.

An electrophotographic image forming device according to one example embodiment includes a housing and a replaceable unit installable into and removable from the housing. The replaceable unit is latchable to and unlatchable from an operating position of the replaceable unit in an interior area of the housing. A positioning stop is movable between a latching position of the positioning stop and an unlatching position of the positioning stop. The positioning stop is positioned to latch the replaceable unit to the housing when the positioning stop is in the latching position and the replaceable unit is in the operating position in the interior area of the housing. A release handle on the replaceable unit is operatively connected to the positioning stop when the replaceable unit is in the operating position in the interior area of the housing to move the positioning stop from the latching position of the positioning stop to the unlatching position of the positioning stop when the release handle moves from a latching position of the release handle to an unlatching position of the release handle to permit removal of the replaceable unit from the housing. The release handle is positioned in the latching position of the release handle when the replaceable unit is in the operating position in the interior area of the housing and the positioning stop is in the latching position of the positioning stop. An access door on the housing is movable between an open position and a closed position permitting access to the interior area of the housing and allowing installation and removal of the replaceable unit into and from the housing. The access door includes an interference feature on an inner side thereof. When the replaceable unit is positioned in the interior area of the housing and the release handle is in the unlatching position of the release handle and the access door moves from the open position toward the closed position, the interference feature contacts the release handle prior to the access door reaching the closed position. When the replaceable unit is positioned in the interior area of the housing and the release handle is in the latching position of the release handle and the access door moves from the open position toward the closed position, the interference feature clears the release handle permitting the access door to reach the closed position.

BRIEF DESCRIPTION OF THE DRAWINGS

The accompanying drawings incorporated in and forming a part of the specification, illustrate several aspects of the present disclosure, and together with the description serve to explain the principles of the present disclosure.

DETAILED DESCRIPTION

In the following description, reference is made to the accompanying drawings where like numerals represent like elements. The embodiments are described in sufficient detail to enable those skilled in the art to practice the present disclosure. It is to be understood that other embodiments may be utilized and that process, electrical, and mechanical changes, etc., may be made without departing from the scope of the present disclosure. Examples merely typify possible variations. Portions and features of some embodiments may be included in or substituted for those of others. The following description, therefore, is not to be taken in a limiting sense and the scope of the present disclosure is defined only by the appended claims and their equivalents.

Figure 1:
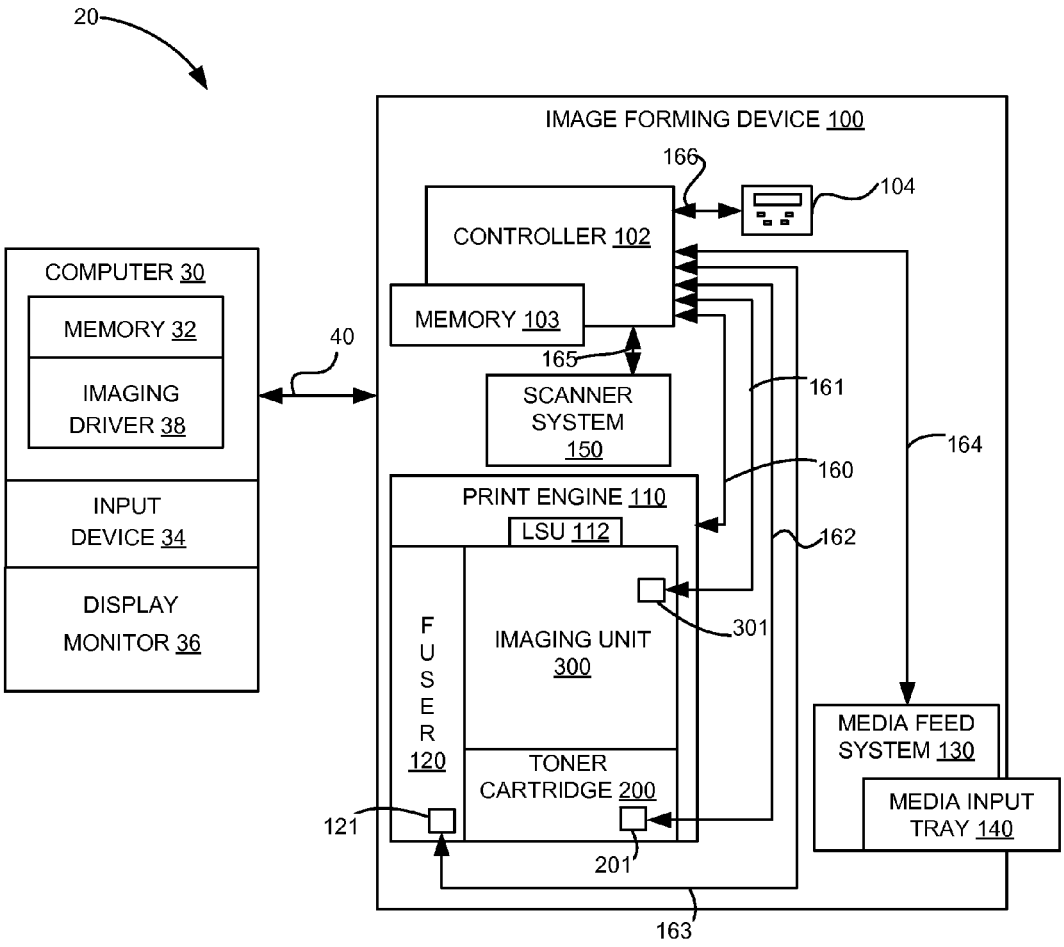
FIG. 1 is a block diagram depiction of an imaging system according to one example embodiment.

Referring now to the drawings and more particularly to FIG. 1, there is shown a block diagram depiction of an imaging system 20 according to one example embodiment. Imaging system 20 includes an image forming device 100 and a computer 30. Image forming device 100 communicates with computer 30 via a communications link 40. As used herein, the term "communications link" generally refers to any structure that facilitates electronic communication between multiple components and may operate using wired or wireless technology and may include communications over the Internet.

In the example embodiment shown in FIG. 1, image forming device 100 is a multifunction machine (sometimes referred to as an all-in-one (AIO) device) that includes a controller 102, a print engine 110, a laser scan unit (LSU) 112, one or more toner bottles or cartridges 200, one or more imaging units 300, a fuser 120, a user interface 104, a media feed system 130 and media input tray 140 and a scanner system 150. Image forming device 100 may communicate with computer 30 via a standard communication protocol, such as, for example, universal serial bus (USB), Ethernet or IEEE 802.xx. Image forming device 100 may be, for example, an electrophotographic printer/copier including an integrated scanner system 150 or a standalone electrophotographic printer.

Controller 102 includes a processor unit and associated memory 103 and may be formed as one or more Application Specific Integrated Circuits (ASICs). Memory 103 may be any volatile or non-volatile memory or combination thereof such as, for example, random access memory (RAM), read only memory (ROM), flash memory and/or non-volatile RAM (NVRAM). Alternatively, memory 103 may be in the form of a separate electronic memory (e.g., RAM, ROM, and/or NVRAM), a hard drive, a CD or DVD drive, or any memory device convenient for use with controller 102. Controller 102 may be, for example, a combined printer and scanner controller.

In the example embodiment illustrated, controller 102 communicates with print engine 110 via a communications link 160. Controller 102 communicates with imaging unit(s) 300 and processing circuitry 301 on each imaging unit 300 via communications link(s) 161. Controller 102 communicates with toner cartridge(s) 200 and processing circuitry 201 on each toner cartridge 200 via communications link(s) 162. Controller 102 communicates with fuser 120 and processing circuitry 121 thereon via a communications link 163. Controller 102 communicates with media feed system 130 via a communications link 164. Controller 102 communicates with scanner system 150 via a communications link 165. User interface 104 is communicatively coupled to controller 102 via a communications link 166. Processing circuitry 121, 201, 301 may include a processor and associated memory such as RAM, ROM, and/or NVRAM and may provide authentication functions, safety and operational interlocks, operating parameters and usage information related to fuser 120, toner cartridge(s) 200 and imaging unit(s) 300, respectively. Controller 102 processes print and scan data and operates print engine 110 during printing and scanner system 150 during scanning.

Computer 30, which is optional, may be, for example, a personal computer, including memory 32, such as RAM, ROM, and/or NVRAM, an input device 34, such as a keyboard and/or a mouse, and a display monitor 36. Computer 30 also includes a processor, input/output (I/O) interfaces, and may include at least one mass data storage device, such as a hard drive, a CD-ROM and/or a DVD unit (not shown). Computer 30 may also be a device capable of communicating with image forming device 100 other than a personal computer such as, for example, a tablet computer, a smartphone, or other electronic device.

In the example embodiment illustrated, computer 30 includes in its memory a software program including program instructions that function as an imaging driver 38, e.g., printer/scanner driver software, for image forming device 100. Imaging driver 38 is in communication with controller 102 of image forming device 100 via communications link 40. Imaging driver 38 facilitates communication between image forming device 100 and computer 30. One aspect of imaging driver 38 may be, for example, to provide formatted print data to image forming device 100, and more particularly to print engine 110, to print an image. Another aspect of imaging driver 38 may be, for example, to facilitate the collection of scanned data from scanner system 150.

In some circumstances, it may be desirable to operate image forming device 100 in a standalone mode. In the standalone mode, image forming device 100 is capable of functioning without computer 30. Accordingly, all or a portion of imaging driver 38, or a similar driver, may be located in controller 102 of image forming device 100 so as to accommodate printing and/or scanning functionality when operating in the standalone mode.

Figure 2:
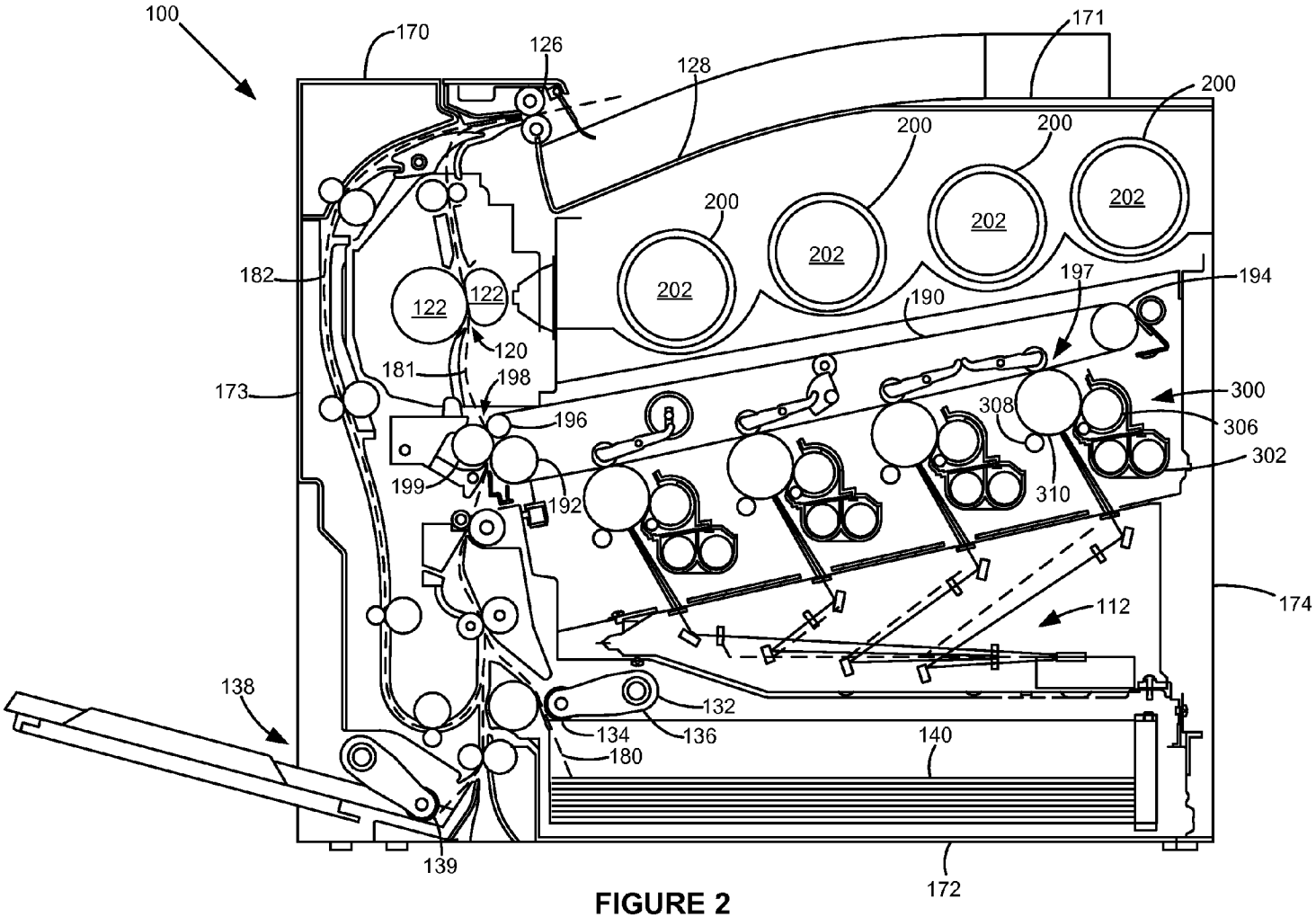
FIG. 2 is a schematic diagram of an image forming device according to one example embodiment.

FIG. 2 illustrates a schematic view of the interior of an example image forming device 100. For purposes of clarity, the components of only one of the imaging units 300 are labeled in FIG. 2. Image forming device 100 includes a housing 170 having a top 171, bottom 172, front 173, rear 174 and a pair of sides (one facing out of the page and one facing into the page as viewed in FIG. 2). Housing 170 includes one or more media input trays 140 positioned therein. Trays 140 are sized to contain a stack of media sheets. As used herein, the term media is meant to encompass not only paper but also labels, envelopes, fabrics, photographic paper or any other desired substrate. Trays 140 are preferably removable for refilling. A media path 180 extends through image forming device 100 for moving the media sheets through the image transfer process. Media path 180 includes a simplex path 181 and may include a duplex path 182. A media sheet is introduced into simplex path 181 from tray 140 by a pick mechanism 132. In the example embodiment shown, pick mechanism 132 includes a roll 134 positioned at the end of a pivotable arm 136. Roll 134 rotates to move the media sheet from tray 140 and into media path 180. The media sheet is then moved along media path 180 by various transport rollers. Media sheets may also be introduced into media path 180 by a manual feed 138 having one or more rolls 139.

In the example embodiment shown, image forming device 100 includes four toner cartridges 200 removably mounted in housing 170 in a mating relationship with four corresponding imaging units 300, which are also removably mounted in housing 170. Each toner cartridge 200 includes a reservoir 202 for holding toner and an outlet port in communication with an inlet port of its corresponding imaging unit 300 for transferring toner from reservoir 202 to imaging unit 300. Toner is transferred periodically from a respective toner cartridge 200 to its corresponding imaging unit 300 in order to replenish the imaging unit 300. In the example embodiment illustrated, each toner cartridge 200 is substantially the same except for the color of toner contained therein. In one embodiment, the four toner cartridges 200 contain yellow, cyan, magenta and black toner, respectively.

In the example embodiment illustrated, image forming device 100 utilizes what is commonly referred to as a dual component development system. Each imaging unit 300 includes a reservoir 302 that stores a mixture of toner and magnetic carrier beads. The carrier beads may be coated with a polymeric film to provide triboelectric properties to attract toner to the carrier beads as the toner and the carrier beads are mixed in reservoir 302. Reservoir 302 and a magnetic roll 306 collectively form a developer unit. Magnetic roll 306 includes a stationary core that includes one or more permanent magnets and a rotatable sleeve that encircles the core. Reservoir 302 may include toner agitators, such as paddles, augers, etc., that stir the developer mix and present the developer mix to magnetic roll 306. Each imaging unit 300 also includes a charge roll 308, a photoconductive drum (PC drum) 310 and a cleaner blade or roll (not shown) that collectively form a photoconductor unit. PC drums 310 are mounted substantially parallel to each other when the imaging units 300 are installed in image forming device 100. In the example embodiment illustrated, each imaging unit 300 is substantially the same except for the color of toner contained therein.

Each charge roll 308 forms a nip with the corresponding PC drum 310. During a print operation, charge roll 308 charges the surface of PC drum 310 to a specified voltage, such as, for example, −1000 volts. A laser beam from LSU 112 is then directed to the surface of PC drum 310 and selectively discharges those areas it contacts to form a latent image. In one embodiment, areas on PC drum 310 illuminated by the laser beam are discharged to approximately −300 volts. The permanent magnet(s) of magnetic roll 306 attract the carrier beads in reservoir 302 having toner thereon to the outer surface of the sleeve of magnetic roll 306. The sleeve of magnetic roll 306 transports the carrier beads having toner thereon past a trim bar that trims the mix of carrier beads and toner to a predetermined average height on the outer surface of the sleeve. The sleeve of magnetic roll 306 then transports the carrier beads having toner thereon to the corresponding PC drum 310. Electrostatic forces from the latent image on PC drum 310 strip the toner from the carrier beads to form a toner image on the surface of PC drum 310.

An intermediate transfer mechanism (ITM) 190 is disposed adjacent to the PC drums 310. In this embodiment, ITM 190 is formed as an endless belt trained about a drive roll 192, a tension roll 194 and a back-up roll 196. During image forming operations, ITM 190 moves past PC drums 310 in a clockwise direction as viewed in FIG. 2. One or more of PC drums 310 apply toner images in their respective colors to ITM 190 at a respective first transfer nip 197. In one embodiment, a positive voltage field attracts the toner images from PC drums 310 to the surface of the moving ITM 190. ITM 190 rotates and collects the one or more toner images from PC drums 310 and then conveys the toner images to a media sheet at a second transfer nip 198 formed between a transfer roll 199 and ITM 190, which is supported by back-up roll 196. The cleaner blade/roll removes any toner remnants on PC drum 310 so that the surface of PC drum 310 may be charged and developed with toner again.

A media sheet advancing through simplex path 181 receives the toner image from ITM 190 as it moves through the second transfer nip 198. The media sheet with the toner image is then moved along the media path 180 and into fuser 120. Fuser 120 includes fusing rolls or belts 122 that form a nip to adhere the toner image to the media sheet. The fused media sheet then passes through exit rolls 126 located downstream from fuser 120. Exit rolls 126 may be rotated in either forward or reverse directions. In a forward direction, exit rolls 126 move the media sheet from simplex path 181 to an output area 128 on top 171 of image forming device 100. In a reverse direction, exit rolls 126 move the media sheet into duplex path 182 for image formation on a second side of the media sheet.

While the example image forming device 100 shown in FIG. 2 illustrates four toner cartridges 200 and four corresponding imaging units 300, it will be appreciated that a monocolor image forming device 100 may include a single toner cartridge 200 and corresponding imaging unit 300 as compared to a multicolor image forming device 100 that may include multiple toner cartridges 200 and imaging units 300. Further, although image forming device 100 utilizes ITM 190 to transfer toner to the media, toner may be applied directly to the media by the one or more photoconductive drums 310 as is known in the art.

While the example image forming device 100 shown in FIG. 2 utilizes a dual component development system, in another embodiment, image forming device 100 utilizes what is commonly referred to as a single component development system. In this embodiment, a toner adder roll in each developer unit has an outer surface that is in contact with and forms a nip with the outer surface of a corresponding developer roll. As the toner adder roll and the developer roll rotate, the toner adder roll supplies toner in reservoir 302 to the developer roll. The developer roll is electrically charged and electrostatically attracts the toner particles supplied by the toner adder roll. A doctor blade positioned along each developer roll provides a substantially uniform layer of toner on the developer roll. The outer surface of the developer roll is also in contact with and forms a nip with the outer surface of a corresponding PC drum 310. As the developer roll and PC drum 310 rotate, toner particles are electrostatically transferred from the developer roll to the latent image on PC drum 310 forming a toned image on the surface of PC drum 310. PC drum 310 is charged by charge roll 308 and cleaned by a cleaner blade/roll as discussed above.

Figure 3:
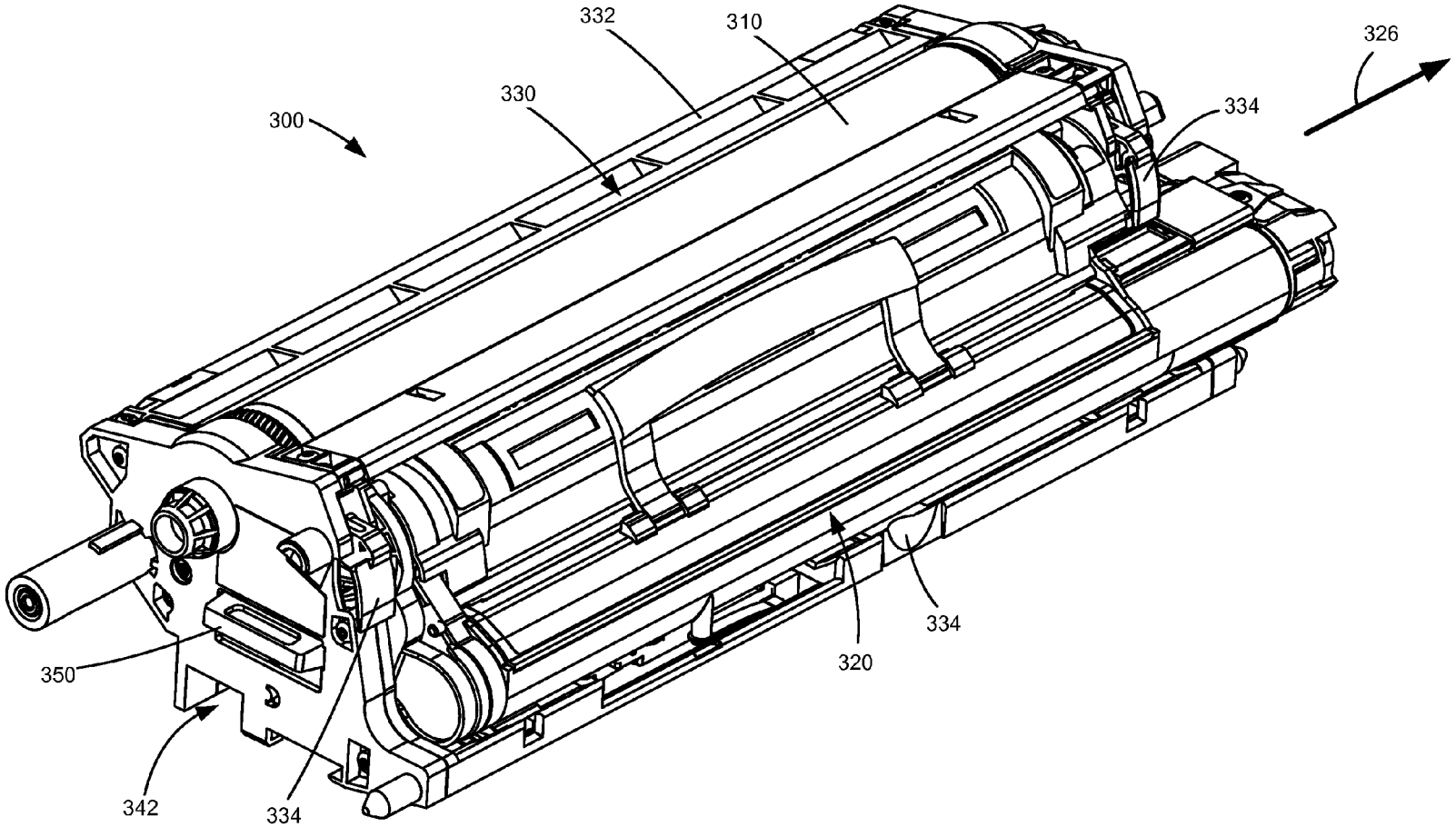
FIG. 3 is a perspective view of an imaging unit including a developer unit and a photoconductor unit according to one example embodiment.
Figure 4:
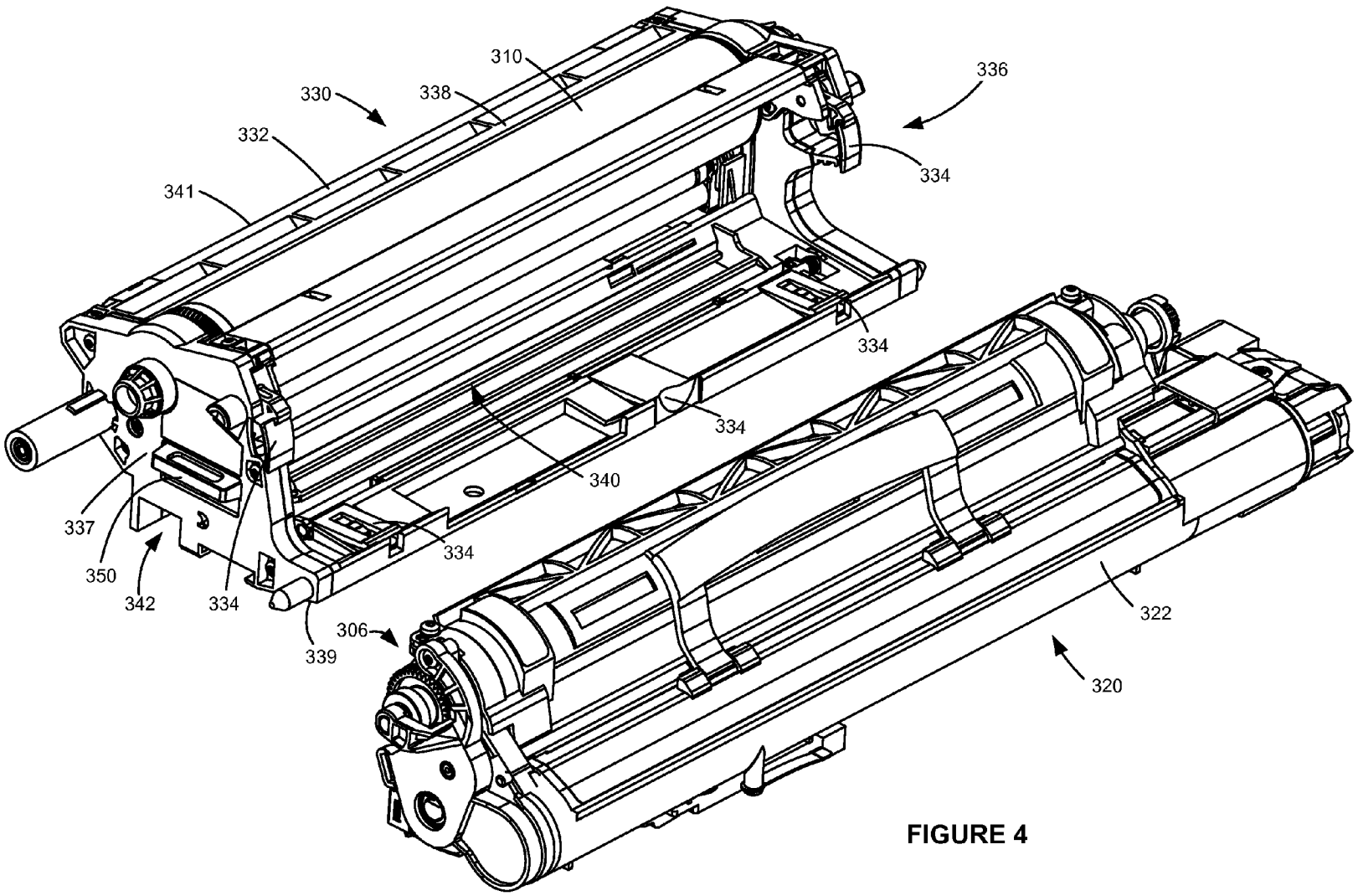
FIG. 4 is a perspective view of the imaging unit showing the developer unit separated from the photoconductor unit according to one example embodiment.

FIGS. 3 and 4 show imaging unit 300 according to one example embodiment. Imaging unit 300 includes a developer unit 320 and a photoconductor unit (PC unit) 330. In the example embodiment illustrated, developer unit 320 is removably coupled to PC unit 330 to permit repair or replacement of developer unit 320 independent of PC unit 330 and vice versa. In other embodiments, developer unit 320 and PC unit 330 are fixed together such that imaging unit 300 is replaced as a single unit. PC unit 330 includes a housing 332 having PC drum 310 as well as charge roll 308 (FIG. 2) and a cleaner blade/roll (not shown) mounted thereto. Housing 332 may also include one or more user-actuated latches 334 that couple developer unit 320 to PC unit 330 as shown in FIG. 3 for operation in image forming device 100 and that permit a user to separate developer unit 320 from PC unit 330 when imaging unit 300 is removed from image forming device 100 as shown in FIG. 4. Developer unit 320 includes a housing 322 having reservoir 302 therein. Housing 322 extends generally along an axial dimension of magnetic roll 306, which is substantially parallel to an axial dimension of PC drum 310. A portion of magnetic roll 306 is exposed from reservoir 302 at one side of housing 322 for mating with PC drum 310 when developer unit 320 is coupled to PC unit 330. When developer unit 320 is coupled to PC unit 330, imaging unit 300 is insertable into image forming device 100 via a sliding motion along an insertion direction 326 as indicated in FIG. 3.

With reference to FIG. 4, housing 332 includes a front end 336 that leads during insertion of PC unit 330 into image forming device 100 and a rear end 337 opposite front end 336 that trails during insertion of PC unit 330 into image forming device 100. In the embodiment illustrated, the axis of PC drum 310 extends along a front-to-rear dimension of housing 332 (i.e., along a horizontal dimension of housing 332 extending from front end 336 to rear end 337). Housing 332 also includes a top 338, a bottom 339 and a pair of sides 340, 341. In the embodiment illustrated, a portion of PC drum 310 is exposed at top 338 of housing 332 where PC drum 310 transfers the toner image formed on the surface of PC drum 310 to ITM 190 or to the print media. A portion of PC drum 310 is also exposed on side 340 of housing 332 facing magnetic roll 306 where toner is transferred to the surface of PC drum 310 by magnetic roll 306 when developer unit 320 is mated with PC unit 330.

Figure 5:
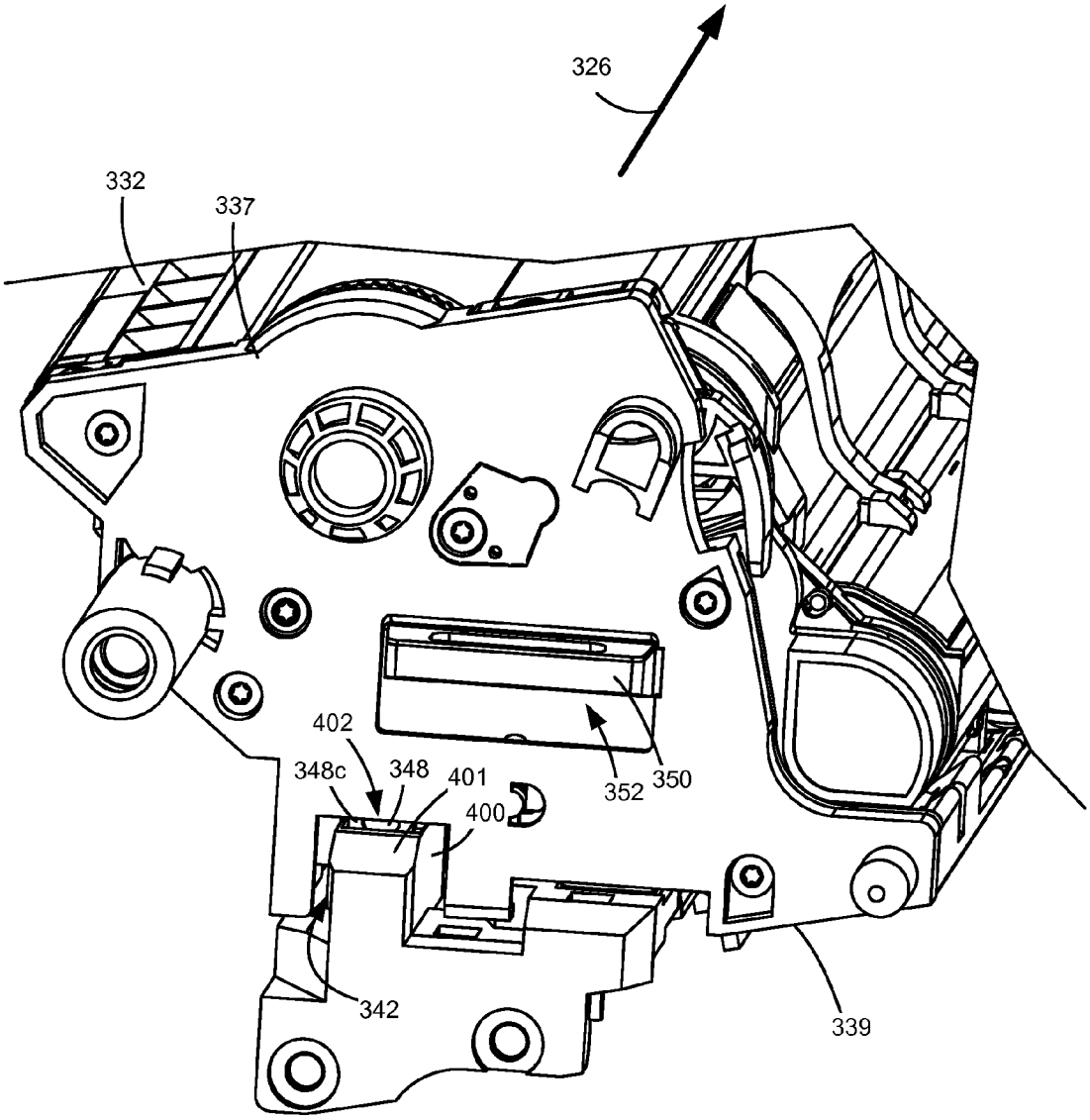
FIG. 5 is a perspective view of a rear end of the imaging unit with the imaging unit installed in the image forming device according to one example embodiment.

FIG. 5 shows rear end 337 of housing 332 in closer detail. A guide channel 342 is formed in the bottom 339 of housing 332 and runs along the length of housing 332 from front end 336 to rear end 337. Guide channel 342 receives and rides on a corresponding guide rail 400 in image forming device 100 when imaging unit 300 is inserted into image forming device 100. The engagement between guide rail 400 and guide channel 342 guides the sliding movement of imaging unit 300 into image forming device 100 and provides coarse alignment of PC unit 330 in a side-to-side dimension (i.e., along a horizontal dimension of housing 332 extending from side 340 to side 341) and a vertical dimension of housing 332 during installation of imaging unit 300 into image forming device 100.

Figure 6:
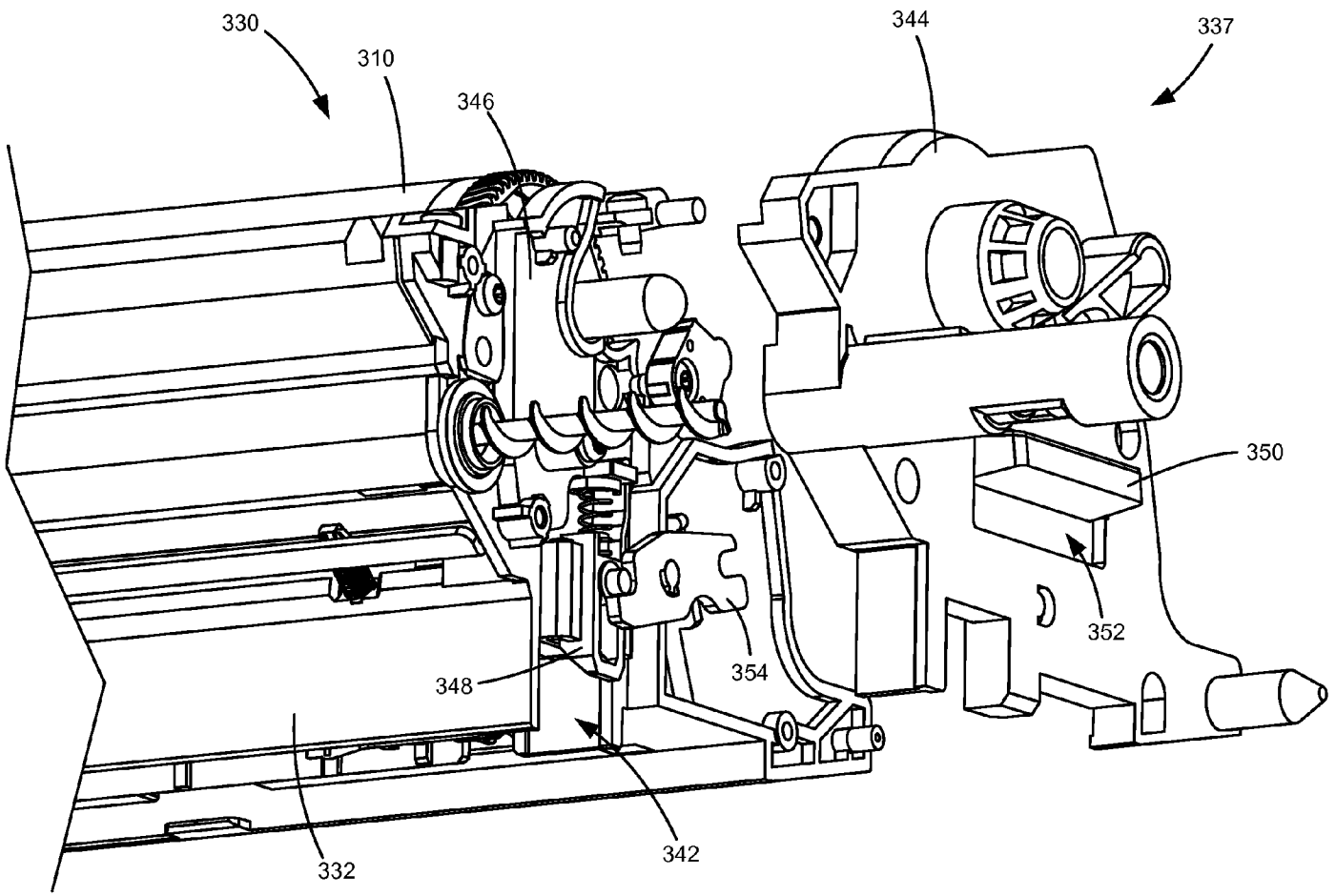
FIG. 6 is an exploded view of a rear end of the photoconductor unit according to one example embodiment.
Figure 7:
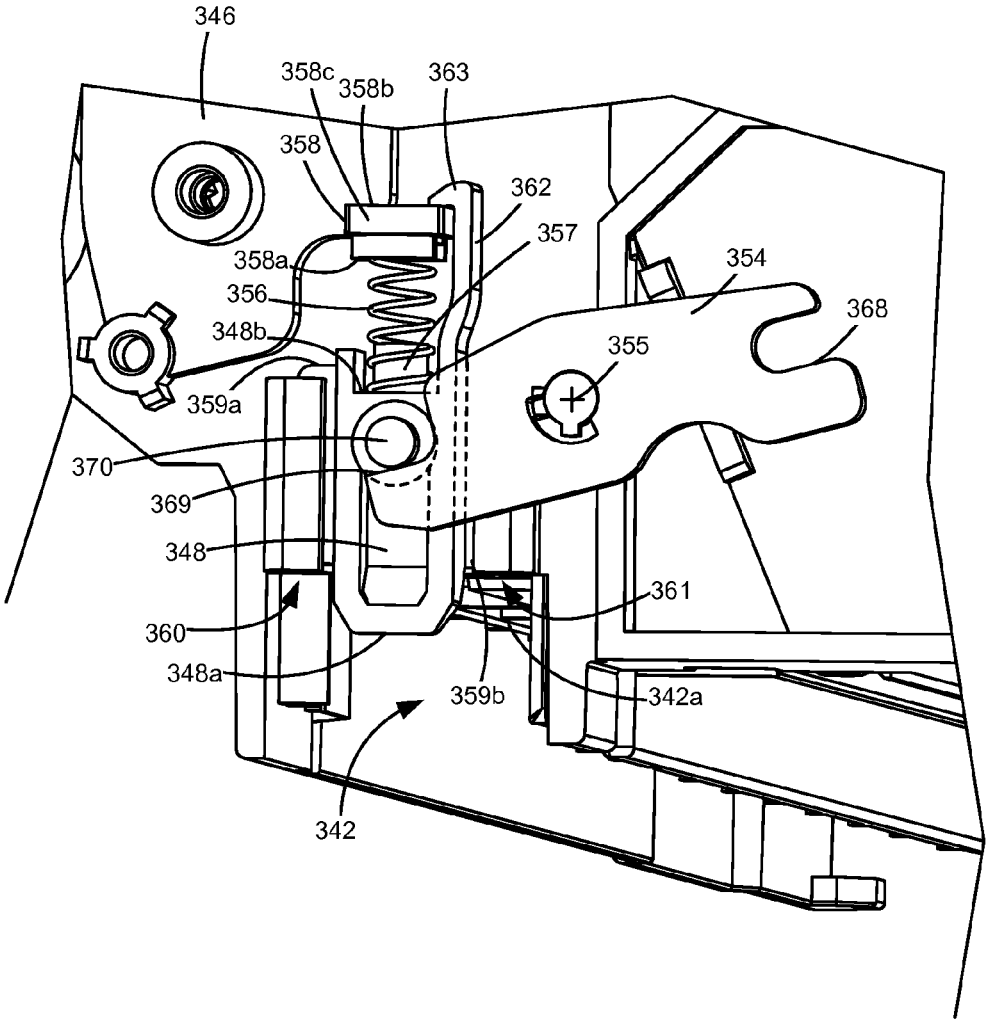
FIG. 7 is a perspective view of the rear end of the photoconductor unit with an end cap and a handle of the photoconductor unit removed to illustrate a positioning stop of the photoconductor unit according to one example embodiment.
Figure 9:
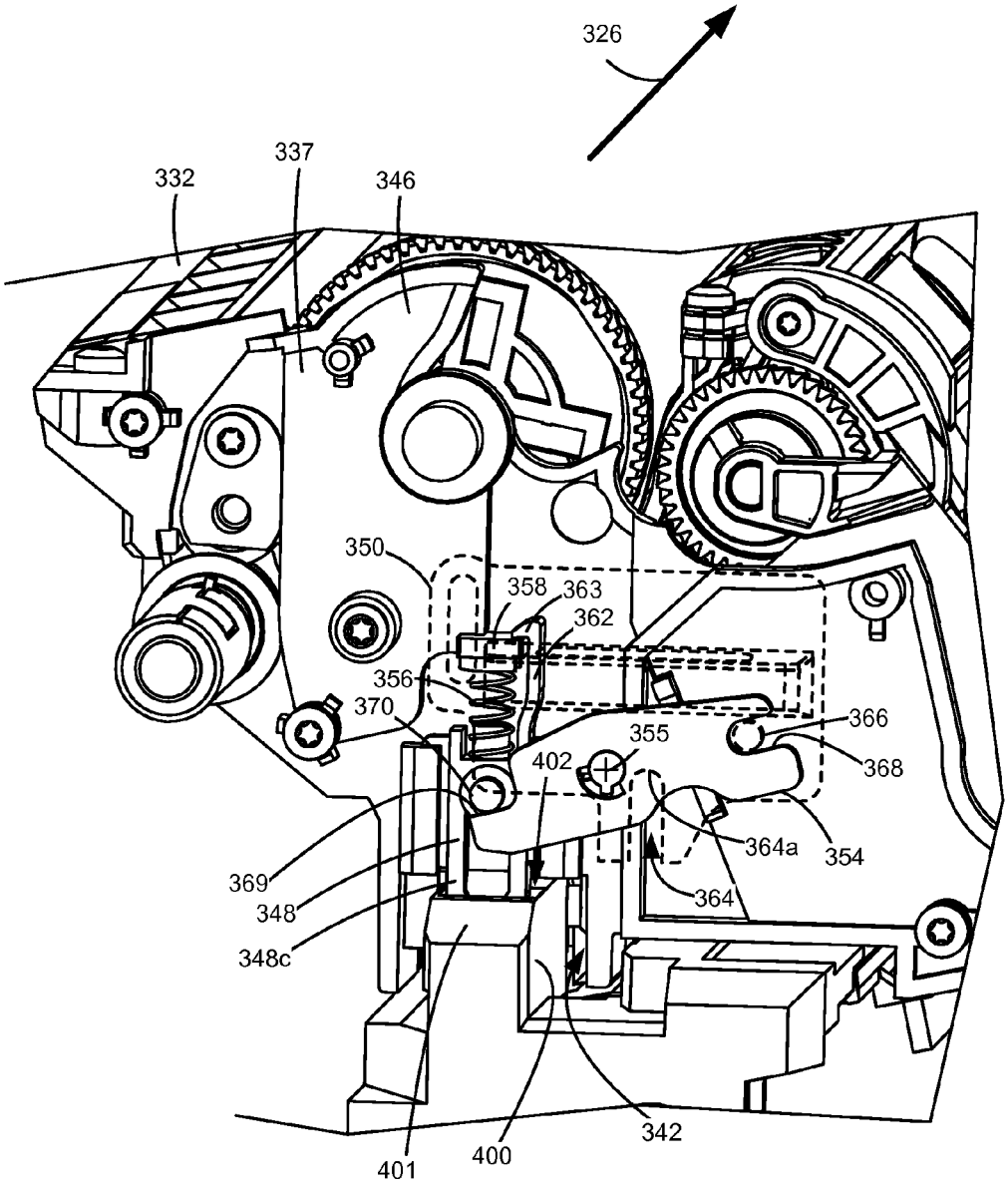
FIG. 9 is a perspective view of the rear end of the photoconductor unit installed in the image forming device with the rear end cap removed to illustrate the handle and the positioning stop in their latching positions according to one example embodiment.

FIG. 6 shows an exploded view of rear end 337 of housing 332. As shown in FIG. 6, in one embodiment, rear end 337 includes an end cap 344 mounted on a rear wall 346 of housing 332. With reference to FIGS. 5 and 6, a positioning stop 348 is positioned at rear end 337 of housing 332. In the embodiment illustrated, positioning stop 348 is mounted on an outer side of rear wall 346 and positioned between an inner side of end cap 344 and the outer side of rear wall 346. In the embodiment illustrated, positioning stop 348 is slidable and translatable up and down between an unlatching position (FIGS. 10 and 11) and a latching position (FIGS. 5, 7 and 9). Positioning stop 348 provides a datum surface that defines the position of PC unit 330 and imaging unit 300 in image forming device 100 along the front-to-rear dimension of housing 332 (the axial dimension of PC drum 310 in the embodiment illustrated) as discussed in greater detail below. In other embodiments, positioning stop 348 is mounted on end cap 344 instead of rear wall 346; however, the mounting of positioning stop 348 on rear wall 346 provides more accurate positioning of PC drum 310 relative to image forming device 100 than the mounting of positioning stop 348 on end cap 344 due to the tolerance stack up between end cap 344 and the portion of housing 332 that supports PC drum 310. A release handle 350 is exposed on an outer side of end cap 344 through an opening 352 in end cap 344. Release handle 350 is operatively connected to positioning stop 348, e.g., by a bell crank 354, to permit a user to move positioning stop 348 from its latching position to its unlatching position as discussed in greater detail below.

FIG. 7 shows rear end 337 of housing 332 with end cap 344 and release handle 350 removed in order to illustrate the mounting of positioning stop 348 on the outer side of rear wall 346 according to one example embodiment. The features of positioning stop 348 obscured by bell crank 354 in FIG. 7 are shown in broken line. Positioning stop 348 is biased downward toward its latching position as shown in FIG. 7. In the latching position of positioning stop 348, a bottom surface 348*a* of positioning stop 348 is positioned lower than a top surface 342*a* of guide channel 342 such that positioning stop 348 obstructs at least a portion of the rear end of guide channel 342. In one embodiment, positioning stop 348 clears guide channel 342 in its unlatching position. In the embodiment illustrated, a compression spring 356 biases positioning stop 348 toward its latching position. Spring 356 is positioned in line with or substantially parallel to the translation of positioning stop 348 between a top surface 348*b* of positioning stop 348 and a bottom surface 358*a* of a post 358 on rear wall 346. In the embodiment illustrated, spring 356 is positioned around a boss 357 on top surface 348*b* of positioning stop 348. Although a compression spring 356 is illustrated, any suitable biasing member may be used to bias positioning stop 348 toward its latching position such as, for example, an extension or leaf spring or a material having resilient properties.

In the example embodiment illustrated, positioning stop 348 is retained in the side-to-side and front-to-rear dimensions of housing 332 by a pair of guide slots 360, 361 positioned on opposite sides of positioning stop 348. Guide slots 360, 361 receive corresponding guide ribs 359*a*, 359*b* of positioning stop 348. Guide ribs 359*a*, 359*b* extend outward from opposite sides of positioning stop 348 (perpendicular to the translation of positioning stop 348) and run vertically between top surface 348*b* and bottom surface 348*a* of positioning stop 348 (in line with or substantially parallel to the translation of positioning stop 348). In one embodiment, guide ribs 359*a*, 359*b* are relatively thin in the front-to-rear dimension of housing 332. In other embodiments, this configuration is reversed and guide slots on positioning stop 348 receive corresponding guide wings on rear wall 346.

In the embodiment illustrated, positioning stop 348 includes a deflectable arm 362 that extends upward from top surface 348*b* of positioning stop 348 (in line with or substantially parallel to the translation of positioning stop 348). Arm 362 includes a hook 363 that wraps above a top surface 358*b* of post 358. Contact between hook 363 and top surface 358*b* of post 358 limits the travel of positioning stop 348 downward toward its latching position. Contact between boss 357 and bottom surface 358*a* of post 358 limits the travel of positioning stop 348 upward toward its unlatching position.

The use of deflectable arm 362 along with guide ribs 359*a*, 359*b* and corresponding guide slots 360, 361 reduces the amount of space occupied by positioning stop 348 in the front-to-rear dimension of housing 332 thereby reducing the footprint of PC unit 330. Deflectable arm 362, guide ribs 359*a*, 359*b* and guide slots 360, 361 also permit relatively easy assembly of positioning stop 348 onto PC unit 330. In the example embodiment illustrated, positioning stop 348 is assembled to rear wall 346 of housing 332 by first sliding positioning stop 348 upward between guide slots 360, 361 with guide ribs 359*a*, 359*b* positioned in guide slots 360, 361 and spring 356 positioned between top surface 348*b* of positioning stop 348 and bottom surface 358*a* of post 358. Positioning stop 348 is then slid further upward until hook 363 of deflectable arm 362 clears and catches on top surface 358*b* of post 358.

Figure 8:
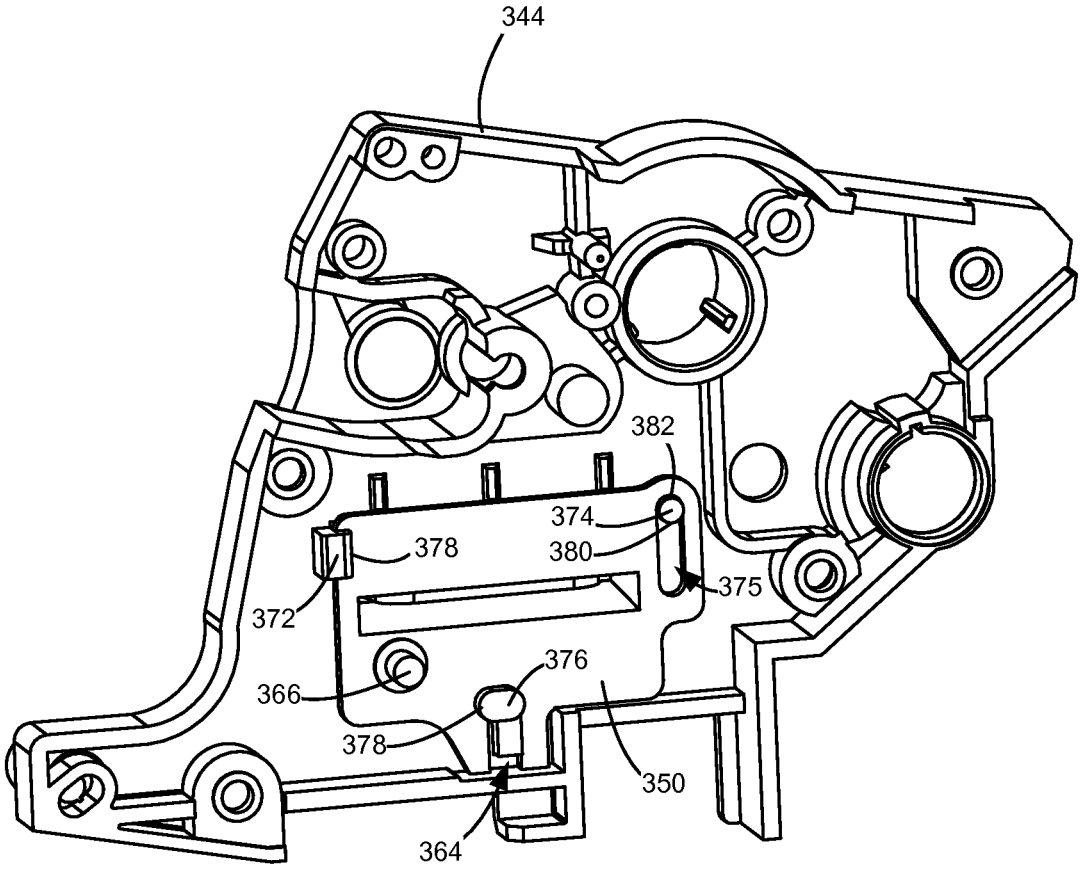
FIG. 8 is a perspective view of an inner side of a rear end cap of the photoconductor unit according to one example embodiment.

FIG. 8 shows the inner side of end cap 344 according to one example embodiment. In the example embodiment illustrated, release handle 350 is mounted on the inner side of end cap 344. In the example embodiment, release handle 350 is translatable up and down between a latching position (FIGS. 5-7, 9) and an unlatching position (FIGS. 8 and 10) of release handle 350. Guides 372, 374 positioned on the inner side of end cap 344 on opposite sides of release handle 350 retain release handle 350 in the side-to-side dimension of housing 332. In the embodiment illustrated, guide 372 includes a rib on the inner side of end cap 344 that is positioned against a side surface of handle 350 and guide 374 includes a post on the inner side of end cap 344 that travels in an elongated vertical slot 375 in handle 350. However, guides 372, 374 may take any suitable form. In the embodiment illustrated, release handle 350 also includes a vertical groove 364 that receives a corresponding guide 376 on the inner side of end cap 344. The engagement between groove 364 and guide 376 aids in guiding the movement of release handle 350 between the latching and unlatching positions of release handle 350. One or more of guides 372, 374 and 376 may include a lip 378 that extends over an inner surface of release handle 350 in order to retain release handle 350 against the inner side of end cap 344 in the front-to-rear dimension of housing 332. Further, in one embodiment, a rear face 358*c* (FIGS. 7, 10 and 11) of post 358 on rear wall 346 is positioned to retain release handle 350 against the inner side of end cap 344 in the front-to-rear dimension of housing 332 when end cap 344 is mounted on rear wall 346. In one embodiment, the inner side of end cap 344 includes an upstop 380 and a downstop 382 that limit the upward and downward travel of release handle 350 toward its latching and unlatching positions. In some embodiments, a top or bottom surface of guide 372, 374 or 376 may form downstop 382 or upstop 380. For example, in the embodiment illustrated, a bottom surface of guide 374 forms upstop 380 and a top surface of guide 374 forms downstop 382. In other embodiments, a top or bottom surface of opening 352 may limit the upward or downward travel of release handle 350. Release handle 350 also includes a boss 366 that extends forward from release handle 350, away from the inner side of release handle 350 and toward the outer side of rear wall 346.

Figure 10:
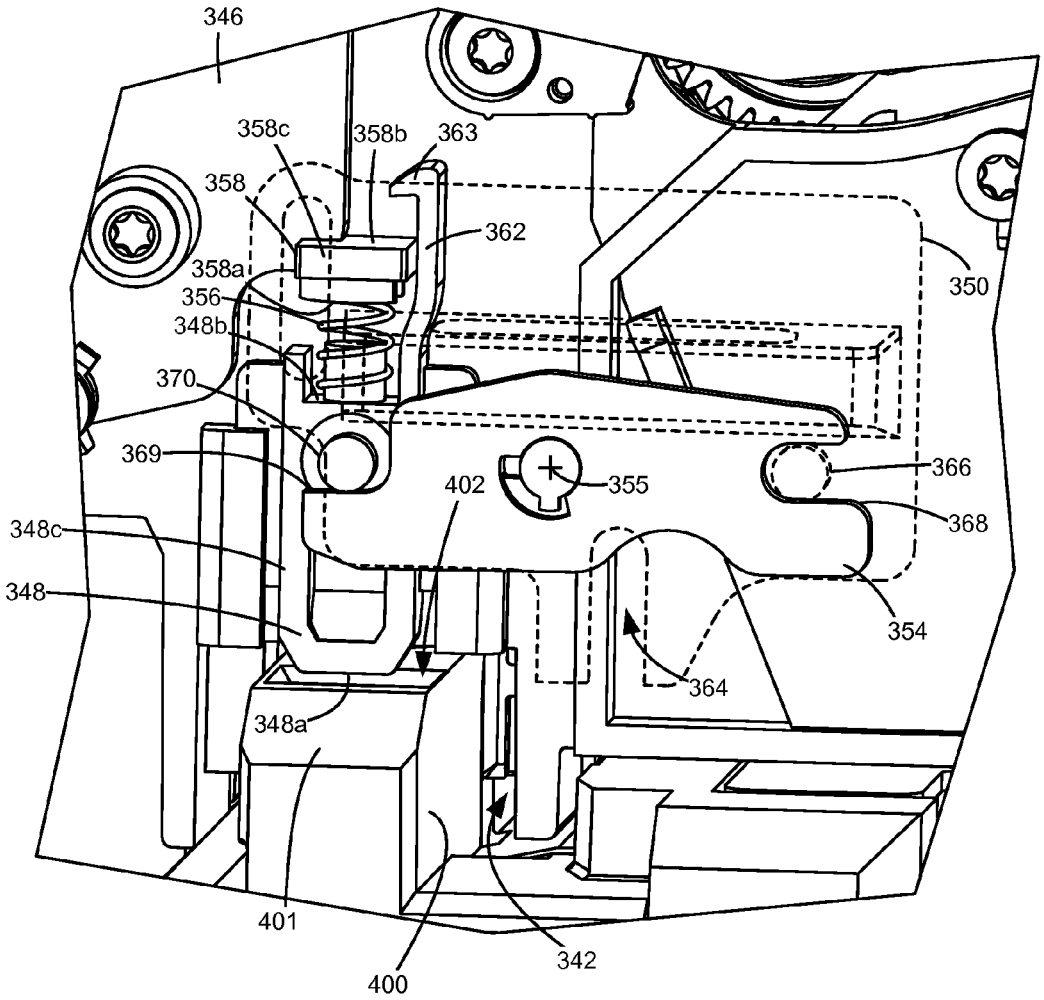
FIG. 10 is a perspective view of the rear end of the photoconductor unit installed in the image forming device with the rear end cap removed to illustrate the handle in and the positioning stop in their unlatching positions according to one example embodiment.
Figure 11:
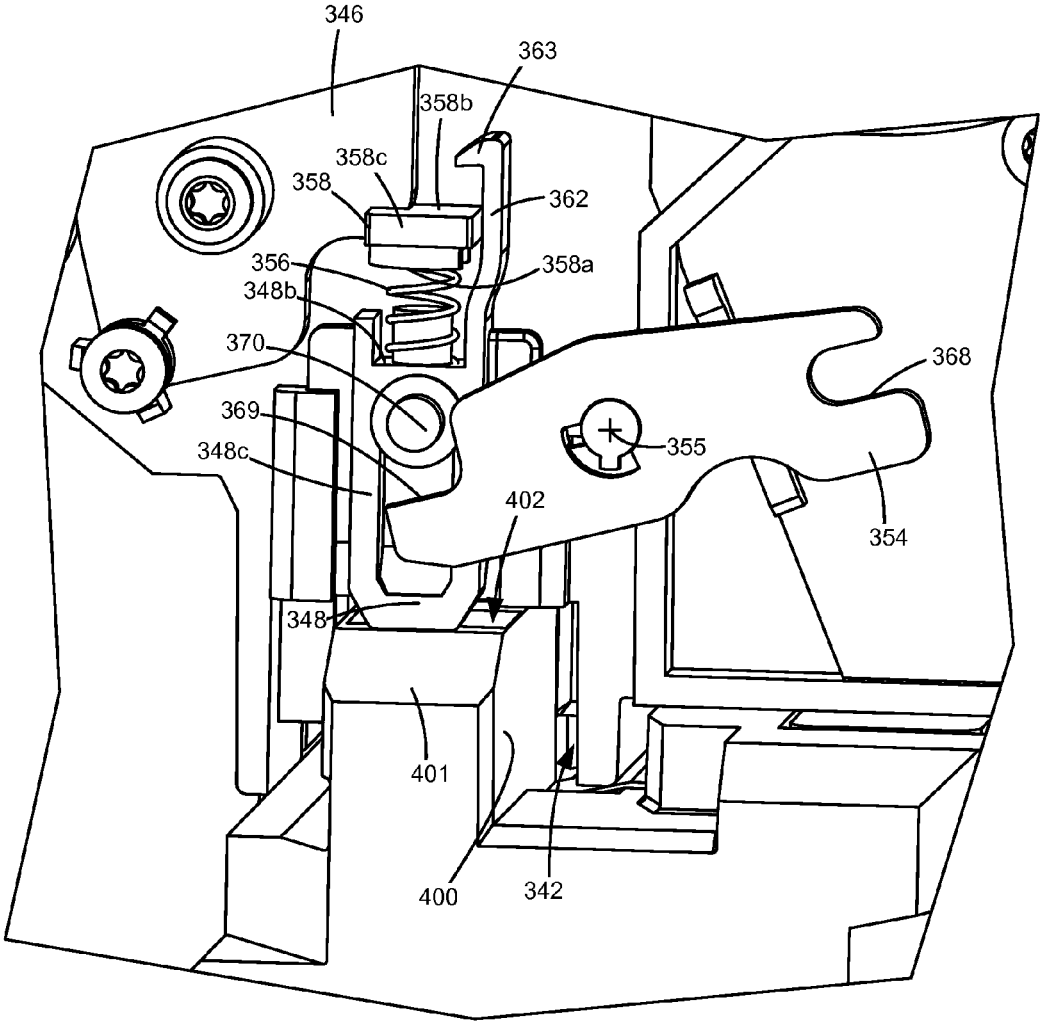
FIG. 11 is a perspective view of the rear end of the photoconductor unit installed in the image forming device with the rear end cap removed to illustrate the handle in its latching position and the positioning stop in its unlatching position according to one example embodiment.

FIGS. 9-11 show rear end 337 of housing 332 with end cap 344 removed but release handle 350 included to more clearly illustrate the operation of release handle 350 and positioning stop 348. Handle 350 is shown in broken line in FIGS. 9 and 10 in order to more clearly illustrate the features of positioning stop 348 and bell crank 354. With reference to FIGS. 7 and 9, bell crank 354 is pivotally mounted to the outer side of rear wall 346 (as shown) or the inner side of end cap 344 about a pivot axis 355. Bell crank 354 is coupled at its first end to release handle 350 such that bell crank 354 pivots when release handle 350 moves up or down between its latching and unlatching positions. For example, in the embodiment illustrated, bell crank 354 includes an engagement slot 368 that receives boss 366 of release handle 350. Bell crank 354 includes an engagement surface 369 at its second end that moves positioning stop 348 from its latching position toward its unlatching position when bell crank 354 pivots as a result of release handle 350 moving from its latching position to its unlatching position.

FIG. 9 shows both release handle 350 and positioning stop 348 in their latching positions. In the example embodiment illustrated, when bell crank 354 pivots clockwise as viewed in FIG. 9 as a result of release handle 350 moving downward from its latching position toward its unlatching position, engagement surface 369 pushes upward on a boss 370 located on positioning stop 348 thereby moving positioning stop 348 from its latching position toward its unlatching position as shown in FIG. 10, which shows both release handle 350 and positioning stop 348 in their unlatching positions. Further, in the embodiment illustrated, bell crank 354 includes sufficient clearance to permit positioning stop 348 to move upward toward its unlatching position independent of bell crank 354 as shown in FIG. 11 and as discussed in greater detail below. In other embodiments, bell crank 354 is coupled to positioning stop 348 such that bell crank 354 pivots when positioning stop 348 moves up or down.

With reference to FIGS. 5 and 9, as imaging unit 300 is inserted into image forming device 100 along insertion direction 326, when PC unit 330 nears its final front-to-rear position in image forming device 100, bottom surface 348*a* of positioning stop 348 contacts a tapered top surface 401 of guide rail 400. The forward travel of imaging unit 300 and contact between bottom surface 348*a* of positioning stop 348 and tapered top surface 401 of guide rail 400 result in an upward force on positioning stop 348 that overcomes the bias applied to positioning stop 348 causing positioning stop 348 to translate upward from its latching position toward its unlatching position where positioning stop 348 is positioned on top of guide rail 400. In one embodiment, bottom surface 348*a* of positioning stop 348 includes a corresponding taper to that of tapered top surface 401 in order to facilitate the rise of positioning stop 348 as imaging unit 300 advances. As positioning stop 348 moves upward, hook 363 separates from top surface 358*b* of post 358. As discussed above, in one embodiment, positioning stop 348 is free to move toward its unlatching position without rotating bell crank 354 as shown in FIG. 11 so that release handle 350 may be in its upward latching position, its downward unlatching position or anywhere in between when imaging unit 300 is inserted into image forming device 100. This allows a user to slide imaging unit 300 into position while holding release handle 350 without worrying about the position on release handle 350 relative to housing 332.

With reference back to FIGS. 5 and 9, as imaging unit 300 is inserted further into image forming device 100, when PC unit 330 reaches its final front-to-rear position in image forming device 100, positioning stop 348 reaches an opening 402 in the top surface of guide rail 400. The bias applied to positioning stop 348 causes positioning stop 348 to translate downward into opening 402 from its unlatching position to its latching position. In one embodiment, PC unit 330 is biased rearward by one or more biasing features in image forming device 100 such that when positioning stop 348 enters opening 402, a rear surface 348*c* of positioning stop 348 is pressed against a corresponding surface inside of opening 402. The contact between rear surface 348*c* of positioning stop 348 and the corresponding surface in opening 402 defines the front-to-rear position of imaging unit 300 to ensure that PC unit 330 and developer unit 320 are accurately positioned for operation in image forming device 100. The movement of positioning stop 348 into opening 402 in guide rail 400 may produce an audible clicking or snapping sound providing feedback to the user that imaging unit 300 is fully installed in image forming device 100. It will be appreciated that positioning stop 348 functions without interaction from the user other than the user pushing imaging unit 300 into image forming device 100. A user does not need to separately actuate positioning stop 348 to install imaging unit 300.

With reference to FIG. 10, in order to remove imaging unit 300 from image forming device 100, a user simply presses down on release handle 350 to move release handle 350 from its latching position to its unlatching position and pulls imaging unit 300 from image forming device 100. The downward movement of release handle 350 causes bell crank 354 to pivot clockwise as viewed in FIG. 10, which, in turn, causes positioning stop 348 to rise from its latching position to its unlatching position clear of opening 402 in guide rail 400. With positioning stop 348 in its unlatching position, a user is free to pull imaging unit 300 from image forming device 100 with guide channel 342 sliding along guide rail 400 to guide the removal of imaging unit 300.

Figure 12:
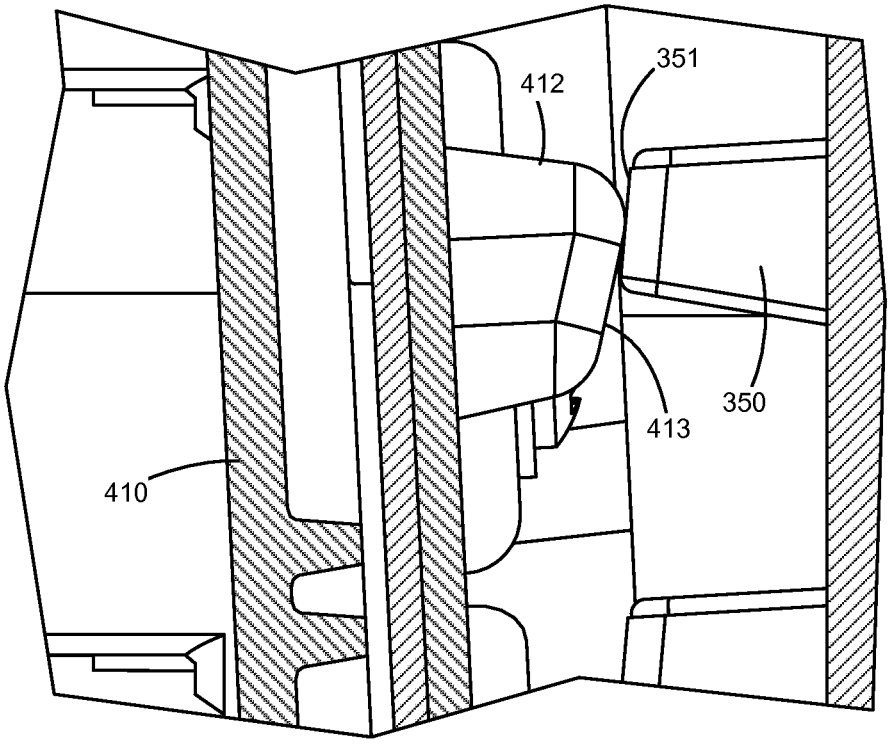
FIG. 12 is a side cross-sectional view of an access door of the image forming device showing an interference feature on an inner side of the access door contacting the handle of the photoconductor unit when the photoconductor unit is not installed completely in the image forming device and the handle is in its unlatching position according to one example embodiment.

A problem may occur if imaging unit 300 is not installed completely in image forming device 100, i.e., if a user inserts imaging unit 300 into image forming device 100 without pushing imaging unit 300 far enough for positioning stop 348 to pass into opening 402 in guide rail 400. With reference to FIG. 12, image forming device 100 includes an access door 410 positioned at rear end(s) 337 of PC unit(s) 330 that permits a user to install and remove imaging unit(s) 300 into and out of image forming device 100. In the example embodiment illustrated, access door 410 is positioned on the side of image forming device 100 facing out of the page as viewed in FIG. 2. In one embodiment, an inner side of access door 410 includes an interference feature 412 positioned to contact release handle 350 if release handle 350 is in its unlatching position. If imaging unit 300 is installed in image forming device 100 close to, but short of, its final position, bottom surface 348*a* of positioning stop 348 will rest on the top surface of guide rail 400 upstream from opening 402 with respect to insertion direction 326 with positioning stop 348 in its unlatching position. In the example embodiment illustrated in FIGS. 5-11, release handle 350 will tend to be in its unlatching position when positioning stop 348 is in its unlatching position due to the weight of release handle 350. When the user closes access door 410 with imaging unit 300 not completely installed in image forming device 100, a face 413 of interference feature 412 contacts a face 351 of release handle 350 as shown in FIG. 12. As the user pushes access door 410 closed, the contact between face 413 of interference feature 412 and face 351 of release handle 350 pushes imaging unit 300 forward to its final position in image forming device 100 where positioning stop 348 is aligned with opening 402 in guide rail 400.

Figure 13:
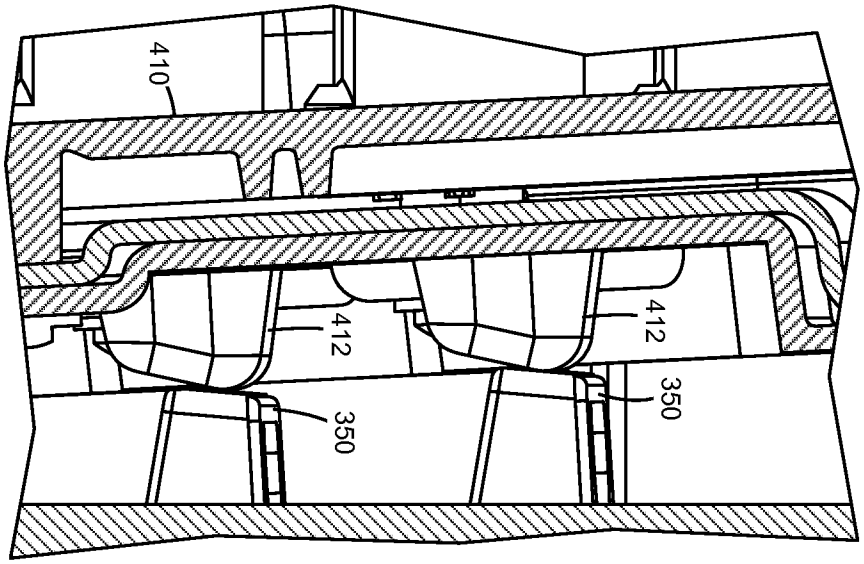
FIG. 13 is a side cross-sectional view of the access door of the image forming device showing multiple interference features on the inner side of the access door positioned to contact the handles of multiple photoconductor units when the photoconductor units are not installed completely in the image forming device according to one example embodiment.

With reference to FIG. 13, where image forming device 100 includes more than one imaging unit 300, access door 410 includes an interference feature 412 for the release handle 350 of each PC unit 330. In one embodiment, the interference features 412 are arranged such that as access door 410 is closed, interference features 412 contact their corresponding release handles 350 one at a time if the release handles 350 are in their unlatching positions so that a user only needs to overcome the force of one imaging unit 300 at a time instead of all imaging units 300 at once in order to reduce the force required to move access door 410 toward its closed position.

With reference back to FIG. 12, in one embodiment, face 413 of interference feature 412 is angled downward and face 351 of release handle 350 is angled upward so that interference feature 412 tends to exert a slight downward force on release handle 350 in order to prevent release handle 350 from rising to its latching position before positioning stop 348 reaches opening 402. If release handle 350 were to rise to its latching position prematurely, interference feature 412 would clear release handle 350 before imaging unit 300 reached its final position in image forming device 100.

Figure 14:
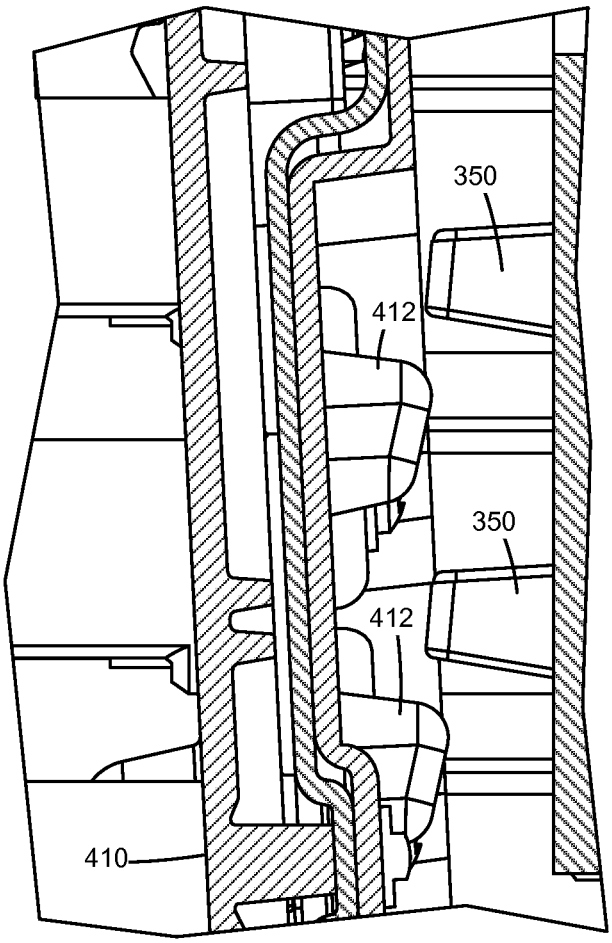
FIG. 14 is a side cross-sectional view of the access door showing the interference feature clearing the handle of the photoconductor unit when the photoconductor unit is installed in the image forming device and the handle is in its latching position according to one example embodiment.
Figure 15:
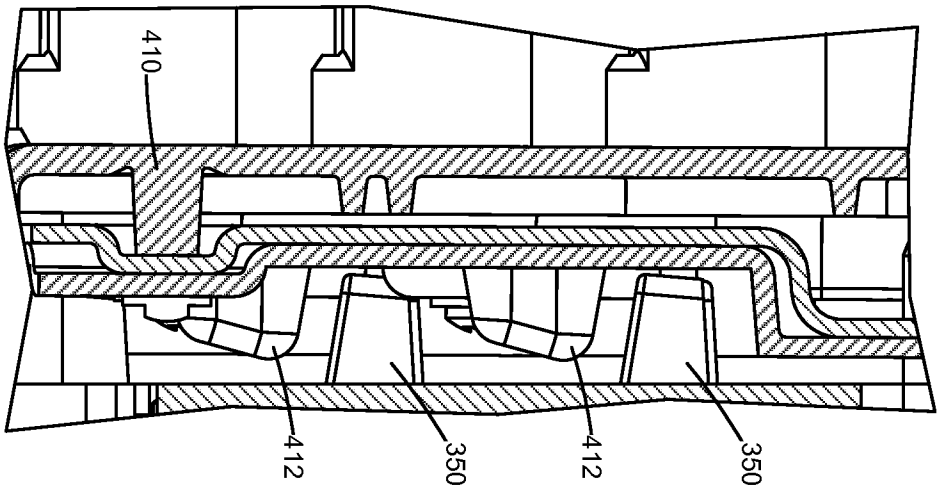
FIG. 15 is a side cross-sectional view of the access door in a closed position with the interference feature clear of the handle of the photoconductor unit according to one example embodiment.

The contact between interference feature 412 and release handle 350 prevents access door 410 from closing all the way. However, when the user opens access door 410 far enough to separate interference feature 412 from release handle 350 upon recognizing that access door 410 is not closed all the way, positioning stop 348 moves into opening 402 in guide rail 400 as a result of the bias applied to positioning stop 348 thereby securing imaging unit 300 in its final position in image forming device 100. Release handle 350, in turn, moves to its latching position clear of interference feature 412 as shown in FIG. 14. Once release handle 350 clears interference feature 412, the user is able to fully close access door 410 as shown in FIG. 15.

Although the example embodiment illustrated shows positioning stop 348 and release handle 350 positioned on PC unit 330, it will be appreciated that a similar configuration may be used on any replaceable unit of image forming device 100 such as, for example, toner cartridge 200 or developer unit 320. Further, although the positioning stop 348 in the embodiment illustrated translates up and down between its latching and unlatching positions, other configurations are possible. For example, positioning stop 348 may translate side-to-side, pivot, etc. Similarly, although the release handle 350 in the embodiment illustrated translates up and down between its latching and unlatching positions, other configurations are possible. For example, release handle 350 may translate side-to-side, translate in-and-out, pivot about an axis that is parallel to the axis of PC drum 310, pivot about an axis that is perpendicular to the axis of PC drum 310, etc. Further, although the example embodiment illustrated shows positioning stop 348 positioned on the replaceable unit and opening 402 that receives positioning stop 348 positioned on housing 170 of image forming device 100, it will be appreciated that this configuration may be reversed by placing positioning stop 348 on housing 170 in position to engage a corresponding opening or surface on the replaceable unit.

The foregoing description illustrates various aspects of the present disclosure. It is not intended to be exhaustive. Rather, it is chosen to illustrate the principles of the present disclosure and its practical application to enable one of ordinary skill in the art to utilize the present disclosure, including its various modifications that naturally follow. All modifications and variations are contemplated within the scope of the present disclosure as determined by the appended claims. Relatively apparent modifications include combining one or more features of various embodiments with features of other embodiments.

The invention claimed is:

1. A replaceable unit for an electrophotographic image forming device, comprising:

a housing having a photoconductive drum rotatably mounted thereon, the photoconductive drum having a rotational axis;

a guide channel on an exterior of the housing that extends parallel to the rotational axis of the photoconductive drum and is positioned to guide insertion of the housing into the image forming device;

a positioning stop on the housing movable between a latching position and an unlatching position, in the latching position the positioning stop obstructs at least a portion of the guide channel to limit the travel of the replaceable unit in the image forming device parallel to the rotational axis of the photoconductive drum; and a release handle on the housing operatively connected to the positioning stop to move the positioning stop from the latching position of the positioning stop to the unlatching position of the positioning stop.

2. The replaceable unit of claim 1, wherein the positioning stop is biased toward the latching position of the positioning stop.

3. The replaceable unit of claim 1, wherein the positioning stop is translatable perpendicular to the rotational axis of the photoconductive drum between the latching position of the positioning stop and the unlatching position of the positioning stop.

4. The replaceable unit of claim 1, wherein the guide channel extends along a bottom side of the housing.

5. The replaceable unit of claim 4, wherein the positioning stop is translatable up and down between the unlatching position of the positioning stop and the latching position of the positioning stop such that the positioning stop translates downward to a position obstructing a top portion of the guide channel when the positioning stop moves from the unlatching position of the positioning stop to the latching position of the positioning stop.

6. The replaceable unit of claim 1, wherein the positioning stop includes clearance permitting the positioning stop to move from the latching position of the positioning stop toward the unlatching position of the positioning stop independent of the release handle.

7. The replaceable unit of claim 1, wherein the guide channel extends from a front end of the housing that leads during insertion of the replaceable unit into the image forming device to a rear end of the housing that trails during insertion of the replaceable unit into the image forming device and the positioning stop and the release handle are positioned at the rear end of the housing.

8. The replaceable unit of claim 7, wherein the rear end of the housing includes an end cap mounted on a rear wall of the housing, the positioning stop and the handle are positioned between an outer side of the rear wall and an inner side of the end cap, and the handle is accessible through an opening in the end cap.

9. The replaceable unit of claim 1, wherein the release handle is translatable perpendicular to the rotational axis of the photoconductive drum between a latching position of the release handle and an unlatching position of the release handle and translation of the release handle from the latching position of the release handle to the unlatching position of the release handle moves the positioning stop from the latching position of the positioning stop to the unlatching position of the positioning stop.

10. The replaceable unit of claim 1, wherein the positioning stop is translatable up and down perpendicular to the rotational axis of the photoconductive drum between the latching position of the positioning stop and the unlatching position of the positioning stop and the release handle is translatable up and down perpendicular to the rotational axis of the photoconductive drum between the latching position of the release handle and the unlatching position of the release handle.

11. The replaceable unit of claim 10, wherein the release handle is operatively connected to the positioning stop by a rotatable bell crank such that when the release handle translates downward from the latching position of the release handle toward the unlatching position of the release handle, the bell crank pivots causing the positioning stop to translate upward from the latching position of the positioning stop toward the unlatching position of the positioning stop.

12. A replaceable unit for an electrophotographic image forming device, comprising:

a housing having a photoconductive drum rotatably mounted thereon, the photoconductive drum having a rotational axis;

a guide channel on an exterior of the housing that extends along a bottom side of the housing parallel to the rotational axis of the photoconductive drum and is positioned to guide insertion of the housing into the image forming device;

a positioning stop on the housing translatable up and down perpendicular to the rotational axis of the photoconductive drum between a latching position and an unlatching position, the positioning stop translates downward from the unlatching position of the positioning stop toward the latching position of the positioning stop and upward from the latching position of the positioning stop toward the unlatching position of the positioning stop, in the latching position the positioning stop obstructs at least a top portion of the guide channel to limit the travel of the replaceable unit in the image forming device parallel to the rotational axis of the photoconductive drum; and a release handle on the housing operatively connected to the positioning stop to move the positioning stop from the latching position of the positioning stop to the unlatching position of the positioning stop.

13. The replaceable unit of claim 12, wherein the positioning stop is biased toward the latching position of the positioning stop.

14. The replaceable unit of claim 12, wherein the positioning stop includes clearance permitting the positioning stop to move from the latching position of the positioning stop toward the unlatching position of the positioning stop independent of the release handle.

15. The replaceable unit of claim 12, wherein the guide channel extends from a front end of the housing that leads during insertion of the replaceable unit into the image forming device to a rear end of the housing that trails during insertion of the replaceable unit into the image forming device and the positioning stop and the release handle are positioned at the rear end of the housing.

16. The replaceable unit of claim 15, wherein the rear end of the housing includes an end cap mounted on a rear wall of the housing, the positioning stop and the handle are positioned between an outer side of the rear wall and an inner side of the end cap, and the handle is accessible through an opening in the end cap.

17. The replaceable unit of claim 12, wherein the release handle is translatable perpendicular to the rotational axis of the photoconductive drum between a latching position of the release handle and an unlatching position of the release handle and translation of the release handle from the latching position of the release handle to the unlatching position of the release handle moves the positioning stop from the latching position of the positioning stop to the unlatching position of the positioning stop.

18. The replaceable unit of claim 17, wherein the release handle is translatable up and down perpendicular to the rotational axis of the photoconductive drum between the latching position of the release handle and the unlatching position of the release handle, wherein the release handle is operatively connected to the positioning stop by a rotatable bell crank such that when the release handle translates downward from the latching position of the release handle toward the unlatching position of the release handle, the bell crank pivots causing the positioning stop to translate upward from the latching position of the positioning stop toward the unlatching position of the positioning stop.

19. An electrophotographic image forming device, comprising:

a housing;

a replaceable unit installable into and removable from the housing, the replaceable unit is latchable to and unlatchable from an operating position of the replaceable unit in an interior area of the housing;

a positioning stop movable between a latching position of the positioning stop and an unlatching position of the positioning stop, the positioning stop is positioned to latch the replaceable unit to the housing when the positioning stop is in the latching position and the replaceable unit is in the operating position in the interior area of the housing;

a release handle on the replaceable unit, the release handle is operatively connected to the positioning stop when the replaceable unit is in the operating position in the interior area of the housing to move the positioning stop from the latching position of the positioning stop to the unlatching position of the positioning stop when the release handle moves from a latching position of the release handle to an unlatching position of the release handle to permit removal of the replaceable unit from the housing, the release handle is positioned in the latching position of the release handle when the replaceable unit is in the operating position in the interior area of the housing and the positioning stop is in the latching position of the positioning stop; and an access door on the housing that is movable between an open position and a closed position permitting access to the interior area of the housing and allowing installation and removal of the replaceable unit into and from the housing, the access door includes an interference feature on an inner side thereof, wherein when the replaceable unit is positioned in the interior area of the housing and the release handle is in the unlatching position of the release handle and the access door moves from the open position toward the closed position, the interference feature contacts the release handle prior to the access door reaching the closed position, wherein when the replaceable unit is positioned in the interior area of the housing and the release handle is in the latching position of the release handle and the access door moves from the open position toward the closed position, the interference feature clears the release handle permitting the access door to reach the closed position.

20. The electrophotographic image forming device of claim 19, wherein when the replaceable unit is positioned in the interior area of the housing and the release handle is in the unlatching position of the release handle, contact between the interference feature and the release handle as the access door moves from the open position toward the closed position moves the replaceable unit to the operating position of the replaceable unit in the interior area of the housing.

21. The electrophotographic image forming device of claim 19, wherein the positioning stop is biased toward the latching position of the positioning stop such that the replaceable unit automatically latches to the housing upon reaching the operating position in the interior area of the housing during installation of the replaceable unit into the housing.

22. The electrophotographic image forming device of claim 19, wherein the positioning stop is positioned on the replaceable unit.

* * * * *